US008873992B2

(12) United States Patent
Sasaki et al.

(10) Patent No.: US 8,873,992 B2
(45) Date of Patent: Oct. 28, 2014

(54) PROCESS CARTRIDGE AND ELECTROPHOTOGRAPHIC IMAGE FORMING APPARATUS

(71) Applicant: Canon Kabushiki Kaisha, Tokyo (JP)

(72) Inventors: Teruhiko Sasaki, Mishima (JP); Ryoji Kusudo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 177 days.

(21) Appl. No.: 13/663,283

(22) Filed: Oct. 29, 2012

(65) Prior Publication Data

US 2013/0114971 A1 May 9, 2013

(30) Foreign Application Priority Data

Nov. 7, 2011 (JP) ..... 2011-243687

(51) Int. Cl.
*G03G 15/00* (2006.01)
*G03G 21/16* (2006.01)
*G03G 21/18* (2006.01)

(52) U.S. Cl.
CPC ..... *G03G 21/1871* (2013.01)
USPC ..... 399/90; 399/111

(58) Field of Classification Search
USPC ..... 399/90, 111
See application file for complete search history.

(56) References Cited

U.S. PATENT DOCUMENTS

| | | | | |
|---|---|---|---|---|
| 5,950,047 | A * | 9/1999 | Miyabe et al. | 399/111 |
| 6,208,817 | B1 * | 3/2001 | Chadani et al. | 399/104 |
| 2003/0123896 | A1 | 7/2003 | Goto | |
| 2003/0215257 | A1 * | 11/2003 | Karakama et al. | 399/90 |
| 2003/0215261 | A1 * | 11/2003 | Karakama et al. | 399/111 |
| 2005/0019061 | A1 * | 1/2005 | Karakama et al. | 399/111 |
| 2006/0024080 | A1 * | 2/2006 | Chadani et al. | 399/90 |
| 2006/0062589 | A1 | 3/2006 | Sasaki | |
| 2009/0196647 | A1 * | 8/2009 | Nishimoto | 399/90 |
| 2011/0044717 | A1 * | 2/2011 | Miyabe et al. | 399/90 |

FOREIGN PATENT DOCUMENTS

| | | | |
|---|---|---|---|
| CN | 1459974 | A | 12/2003 |
| CN | 1749884 | A | 3/2006 |
| JP | 2002-040905 | A | 2/2002 |

* cited by examiner

*Primary Examiner* — David Bolduc
(74) *Attorney, Agent, or Firm* — Canon USA Inc IP Division

(57) ABSTRACT

A process cartridge includes a first engaging portion and a second engaging portion. The first engaging portion is configured to engage with a first body engaging portion of a body supporting member to temporarily position the body supporting member in a longitudinal direction of the process cartridge before the process cartridge is mounted to a cartridge mounting position provided in an image forming apparatus body and before a body electrical contact is electrically connected to a cartridge electrical contact. The second engaging portion is configured to engage with a second body engaging portion of the body supporting member to position the body supporting member in the longitudinal direction of the process cartridge after mounting of the process cartridge to the cartridge mounting position is further advanced.

14 Claims, 17 Drawing Sheets

FRONT

BACK

PERSPECTIVE 53
53a
53b1
53b2
53c1
53c2
53c3
53c4
53d
54
54a
54b
51
51a
52
52a
52b
52c
52d
52e
56
57
F
H1
H2
E1
E
E2

FIG.14A1
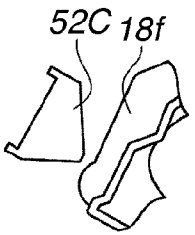
FIG.14B1
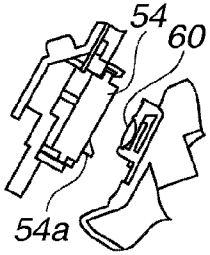
FIG.14C1
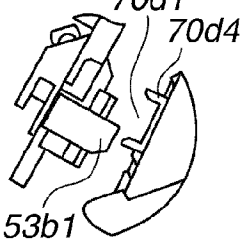
FIG.14D1
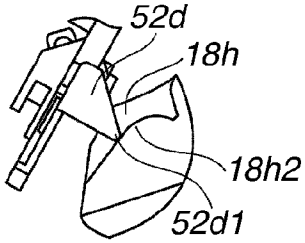
FIG.14A2
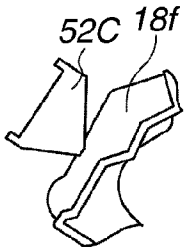
FIG.14B2
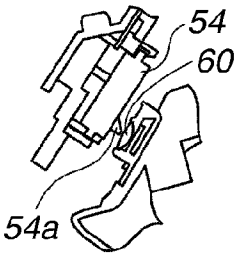
FIG.14C2
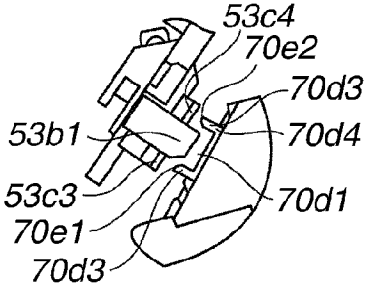
FIG.14D2
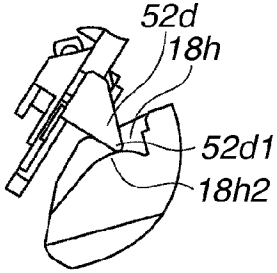
FIG.14A3
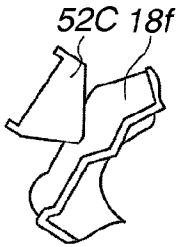
FIG.14B3
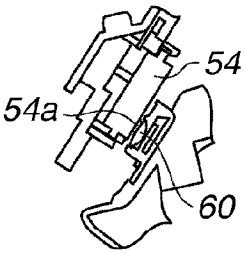
FIG.14C3
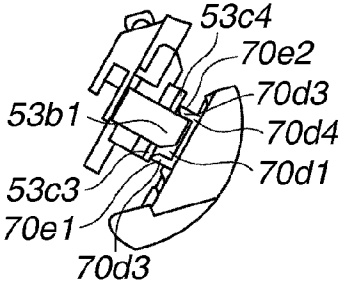
FIG.14D3
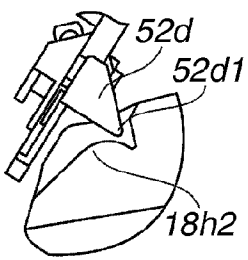

PROCESS CARTRIDGE AND ELECTROPHOTOGRAPHIC IMAGE FORMING APPARATUS

BACKGROUND OF THE INVENTION

1. Field of the Invention

The present invention relates an electrophotographic image forming apparatus to which a process cartridge is detachably mountable, and a process cartridge detachably mountable to the electrophotographic image forming apparatus.

Here, an electrophotographic image forming apparatus (hereafter, referred to as an image forming apparatus) forms an image on a recording medium with the use of an electrophotographic image forming method. Examples of the image forming apparatus include an electrophotographic copying machine, an electrophotographic printer (for example, a laser printer, a light-emitting diode (LED) printer, etc.) a facsimile machine, a wordprocessor, and a multifunction peripheral.

The process cartridge has at least one process unit configured to act on an electrophotographic photosensitive drum as an image bearing member, and is detachably mountable to a body of the image forming apparatus as a cartridge. At least any one of a charging unit, a developing unit, and a cleaning unit may be included as the process unit. Examples of the process unit include a process cartridge obtained by integrating a process unit and an electrophotographic photosensitive drum as a cartridge and detachably mountable to the body of the image forming apparatus.

2. Description of the Related Art

In an image forming apparatus which uses an electrophotographic image formation process, a process cartridge system in which the process cartridge is detachably mountable to the body of the image forming apparatus has been employed. The process cartridge system makes it possible for a user himself to maintain the image forming apparatus without relying on a service engineer. Therefore, the operability of the image forming apparatus can be drastically improved. Thus, the process cartridge system is widely used in the image forming apparatus.

In order to obtain a satisfactory image in the image forming apparatus which uses the process cartridge (hereinafter, referred to as the cartridge), the cartridge is to be precisely mounted in a predetermined cartridge mounting position in the image forming apparatus. Interfacing portions such as various electrical contacts, and driving force transmitting portions are to be correctly connected.

Then, an image forming apparatus has been known (U.S. Patent Application Publication No. 2003-0123896). In the image forming apparatus, a movable member having a body electrical contact is moved by an abutting portion provided at the tip of a cartridge frame member. After the movable member is positioned in a direction intersecting with a mounting direction, the body electrical contact is connected to a cartridge electrical contact. Thus, the body electrical contact provided in the image forming apparatus can be correctly connected to the cartridge electrical contact provided in the cartridge.

An image forming apparatus has been known (U.S. Patent Application Publication No. 2006-0062589). In the image forming apparatus, in order to reduce a body electrical contact and a cartridge electrical contact in size, before the body electrical contact is electrically connected to the cartridge electrical contact, the body electrical contact is positioned in a longitudinal direction of a cartridge and in a direction intersecting with the longitudinal direction.

In light of dispersion of component sizes and a difference between coefficients of linear expansion caused by a material difference of a component in the image forming apparatus and the cartridge, proper play (clearance) is required between the image forming apparatus and the cartridge in the longitudinal direction of the process cartridge. Furthermore, it is necessary to set an amount of play to be greater in a long cartridge. However, the cartridge may be slanted by the play when the cartridge is mounted/removed to/from the image forming apparatus.

SUMMARY OF THE INVENTION

The present invention is directed to a cartridge capable of engaging with a body supporting member having a body electrical contact even when the cartridge is obliquely mounted to an image forming apparatus, or to an image forming apparatus to which the cartridge is detachably mountable.

According to an aspect of the present invention, a process cartridge is detachably mountable to an image forming apparatus body including a body supporting member configured to be movable and a body electrical contact supported by the body supporting member. The process cartridge includes: a process unit configured to act on an electrophotographic photosensitive member; a memory member configured to store information about the process cartridge; a cartridge electrical contact electrically connected to the memory member; a first engaging portion configured to engage with a first body engaging portion of the body supporting member to temporarily position the body supporting member in a longitudinal direction of the process cartridge before the process cartridge is mounted to a cartridge mounting position provided in the image forming apparatus body and before the body electrical contact is electrically connected to the cartridge electrical contact; and a second engaging portion configured to engage with a second body engaging portion of the body supporting member to position the body supporting member in the longitudinal direction of the process cartridge after mounting of the process cartridge to the cartridge mounting position is further advanced. A clearance between the first engaging portion and the first body engaging portion is greater than a clearance between the second engaging portion and the second body engaging portion in a state where the body supporting member engages with the second engaging portion.

According to another aspect of the present invention, an electrophotographic image forming apparatus includes a process cartridge detachably mountable to an image forming apparatus body. The image forming apparatus body includes: a body supporting member configured to be movable; a body electrical contact supported by the body supporting member; and a mounting portion configured to detachably mount the process cartridge. The process cartridge includes: a process unit configured to act on an electrophotographic photosensitive member; a memory member configured to store information about the process cartridge; a cartridge electrical contact electrically connected to the memory member; a first engaging portion configured to engage with a first body engaging portion of the body supporting member to temporarily position the body supporting member in a longitudinal direction of the process cartridge before the process cartridge is mounted to a cartridge mounting position provided in the image forming apparatus body and before the body electrical contact is electrically connected to the cartridge electrical contact; and a second engaging portion configured to engage with a second body engaging portion of the body supporting member to position the body supporting member in the longitudinal direction of the process cartridge after mounting of the process cartridge to the cartridge mounting position is further advanced. A clearance between the first engaging portion and the first body engaging portion is greater than a clearance between the second engaging portion and the second body engaging portion in a state where the body supporting member engages with the second engaging portion.

According to exemplary embodiments of the present invention, the cartridge can engage with the body supporting member having the body electrical contact when the cartridge is obliquely mounted to the image forming apparatus. Thus, the body electrical contact can be precisely brought into contact with the cartridge electrical contact.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 14A1, 14A2, 14A3, 14B1, 14B2, 14B3, 14C1, 14C2, 14C3, 14D1, 14D2, and 14D3 are sectional views illustrating a method for connecting the electrical contacts according to the exemplary embodiment of the present invention.

DESCRIPTION OF THE EMBODIMENTS

Various exemplary embodiments, features, and aspects of the invention will be described in detail below with reference to the drawings.

Figure 1:
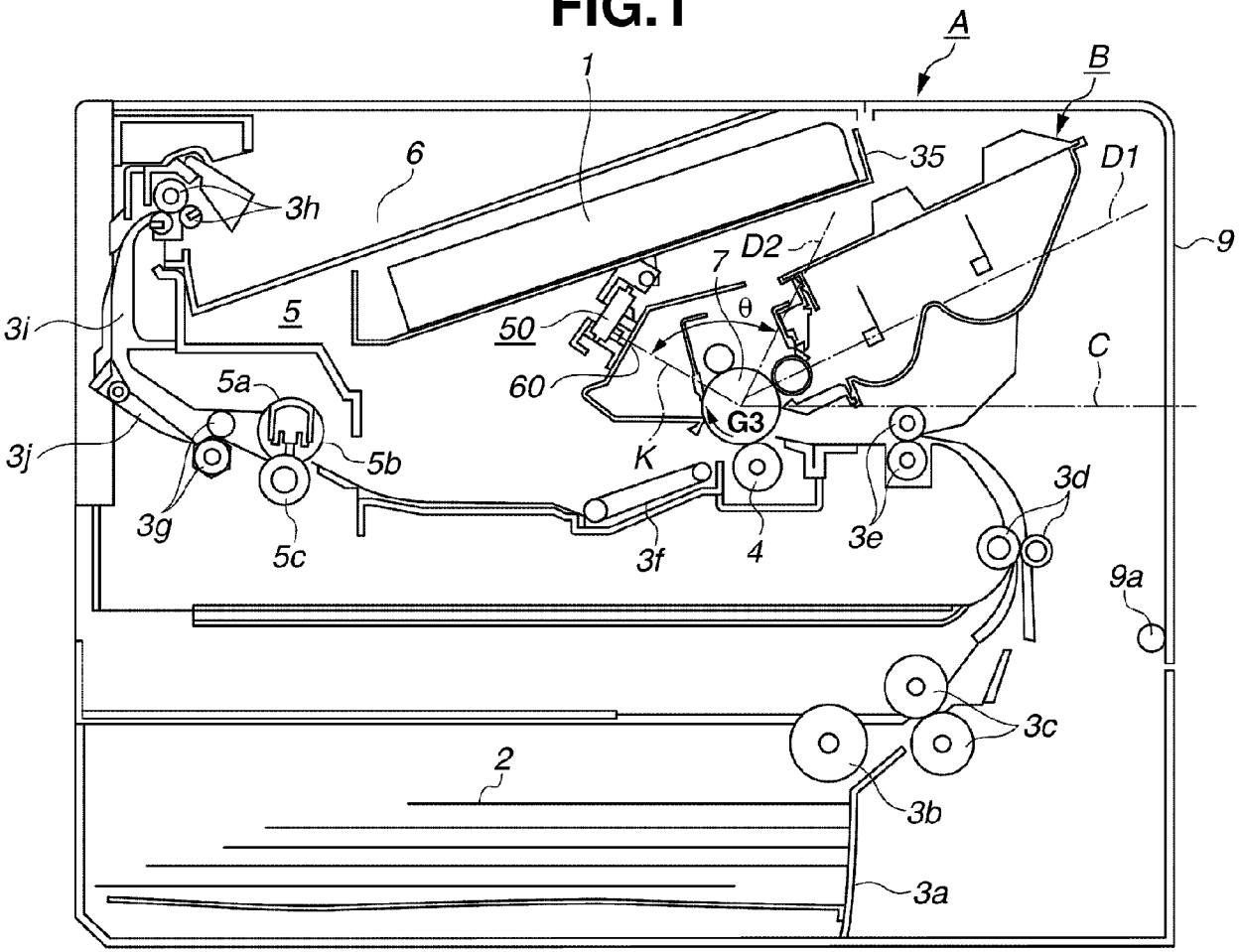
FIG. 1 is a schematic view illustrating an image forming apparatus according to an exemplary embodiment of the present invention.
Figure 2:
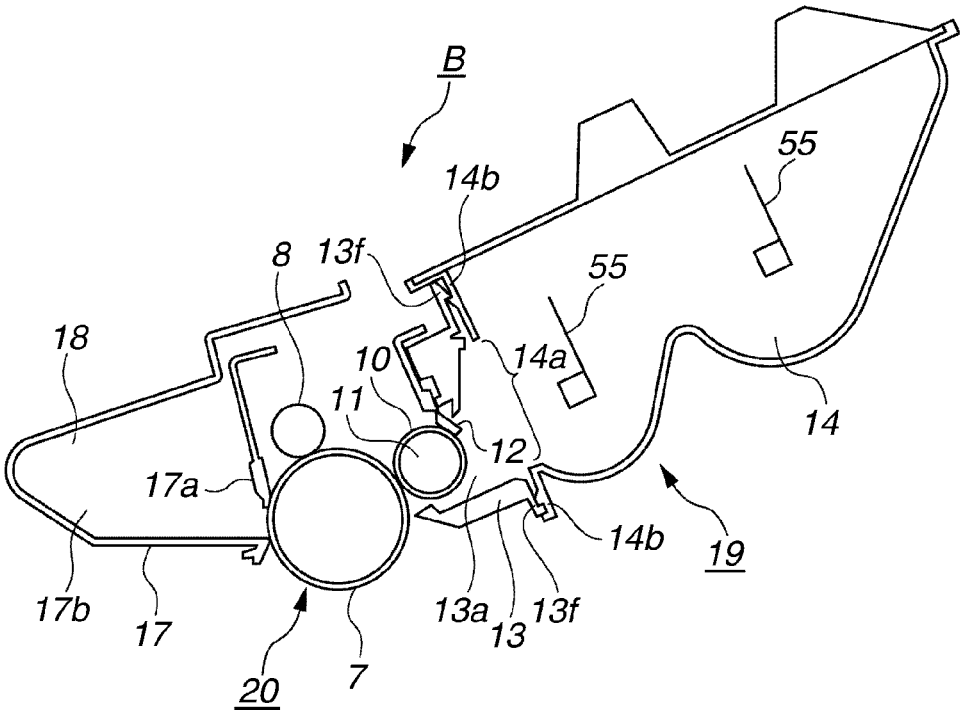
FIG. 2 is a sectional view illustrating a process cartridge according to the exemplary embodiment of the present invention.

First, referring to FIGS. 1 and 2, an image forming apparatus to which a process cartridge according to an exemplary embodiment of the present invention is removably mountable will be described. FIG. 1 is a schematic view illustrating a structure of a body A of an image forming apparatus (hereinafter, an apparatus body) according to the exemplary embodiment of the present invention. FIG. 2 is a sectional view of a cartridge B detachably mountable to the apparatus body A according to the exemplary embodiment of the present invention. The apparatus body A means a portion excluding the cartridge B in the image forming apparatus.

Here, the image forming apparatus forms an image on a recording medium (for example, recording paper, OHP sheet, fabric, etc.) using an electrophotographic image forming process. The image forming apparatus includes, for example, an electrophotographic copying machine, an electrophotographic printer (for example, an LED printer, a laser-beam printer, etc.), an electrophotographic facsimileing apparatus, and an electrophotographic wordprocessor. The exemplary embodiment will be described with reference to a laser-beam printer using the electrophotographic image forming process as the image forming apparatus.

The image forming apparatus A includes an electrophotographic photosensitive member 7 in the form of a drum (hereinafter, referred to as a photosensitive drum 7) as an image bearing member. The photosensitive drum 7 is charged by a charge roller 8, which is a charging unit. The charged photosensitive drum 7 is then exposed to a laser beam light according to image formation, from an optical device 1 as an optical unit having a laser diode, a polygon mirror, a lens, a reflecting mirror. As a result, an electrostatic latent image corresponding to the image formation is formed on the photosensitive drum 7.

This electrostatic latent image is developed into a visible image, that is, an toner image, by a developing device as a developing unit, and a developer (hereinafter, referred to as a toner).

Meanwhile, in synchronism with the formation of the toner image, a recording medium 2 placed in a cassette 3*a* is conveyed from the cassette 3*a* to a transfer position, by a pickup roller 3*b*, and conveyance roller pairs 3*c*, 3*d*, and 3*e*. In the transfer position, a transfer roller 4 as a transferring unit is arranged so that the recording medium 2 is nipped between the transfer roller 4 and the photosensitive drum 7. Voltage is applied to the transfer roller 4, thereby transferring the toner image on the photosensitive drum 7, onto the recording medium 2.

After the transfer of the toner image onto the recording medium 2 in the transfer position, the recording medium 2 is conveyed to a fixing device 5 as a fixing unit, by way of a conveyance guide 3*f*.

The fixing device 5 is provided with a drive roller 5*c*, and a fixation roller 5*b* containing a heater 5*a*. While the recording medium 2 is moved through the fixing device 5, the fixing device 5 applies heat and pressure to the recording medium 2 so that the toner image transferred onto the recording medium 2 is fixed to the recording medium 2.

After the fixation, the recording medium 2 is conveyed by discharge roller pairs 3*g* and 3*h*. The recording medium 2 is discharged into a tray 6 through a reversal path 3*i*.

It is possible to activate a pivotable flapper 3*j* in order to discharge the recording medium 2 without moving through the reversal path 3*i*. The pickup roller 3*b*, the conveyance roller pairs 3*c*, 3*d*, and 3*e*, the conveyance guide 3*f*, and the discharge roller pairs 3*g* and 3*h*, etc., constitute a conveying unit for the recording medium 2.

The cartridge B will be described referring to FIG. 2. While the photosensitive drum 7 is rotated by a drive unit (not illustrated), the peripheral surface thereof is uniformly charged by the voltage being applied to the charge roller 8, which is a charging unit. Then, a latent image is formed on the photosensitive drum 7 by projecting the laser beam light according to image formation from an optical device 1. The latent image is developed with the use of a developing device 19 and the toner.

To describe in more detail, the charge roller 8 is provided in contact with the photosensitive drum 7, and charges the photosensitive drum 7. The charge roller 8 is rotated by the rotation of the photosensitive drum 7. The developing device 19 supplies the toner to the developing region of the photosensitive drum 7, thereby developing the latent image formed on the photosensitive drum 7.

The developing device 19 sends the toner in a developer container (hereinafter, referred to as a toner container) 14 to a developing chamber 13*a* by the rotation of a stirring member 55. As a developing roller 10 as a developing unit, which contains a magnet roller 11 (stationary magnet) is rotated, a triboelectrically charged toner layer is formed on the surface of the developing roller 10 by a developing blade 12. The toner is transferred from the surface of the toner layer, onto the photosensitive drum 7 in the pattern of the latent image. Thereby, the developing roller 10 forms the toner image, and develops the latent image into a visible image. The developing blade 12 controls the amount of the toner on the peripheral surface of the developing roller 10 while frictionally charging the toner.

The toner image is transferred onto the recording medium 2 by the transfer roller 4 as the transferring unit. After the transfer, the toner remaining on the photosensitive drum 7 is removed by a cleaning device 17, and the cleaned photosensitive drum 7 is then used for the following image formation process. The cleaning device 17 has an elastic cleaning blade 17*a*, as a cleaning unit, provided to abut on the photosensitive drum 7. The elastic cleaning blade 17*a* scrapes down the residual toner remaining on the photosensitive drum 7 after the transfer, and collects the removed residual toner into a waste toner bin 17*b*.

Figure 3:
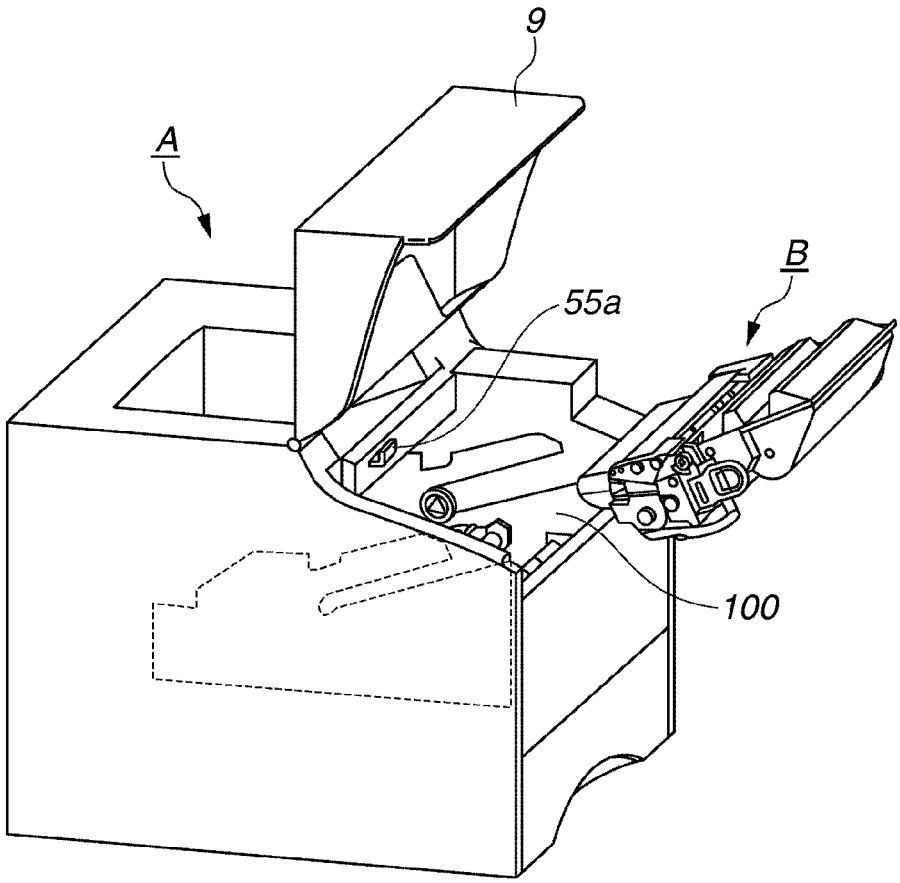
FIG. 3 is an external perspective view of the image forming apparatus of the exemplary embodiment, into which the process cartridge is inserted.

As illustrated in FIG. 3, the user opens a cartridge cover 9 (hereinafter, referred to as a cover 9) as an opening/closing cover provided in the apparatus body A to open an opening 100 (open position). Then, the cartridge B is removably mounted, by the user, to a cartridge mounting unit provided in the apparatus body A through the opening 100. The cartridge B is mounted into, or removed from, the apparatus body A through the opening 100.

Figure 4:
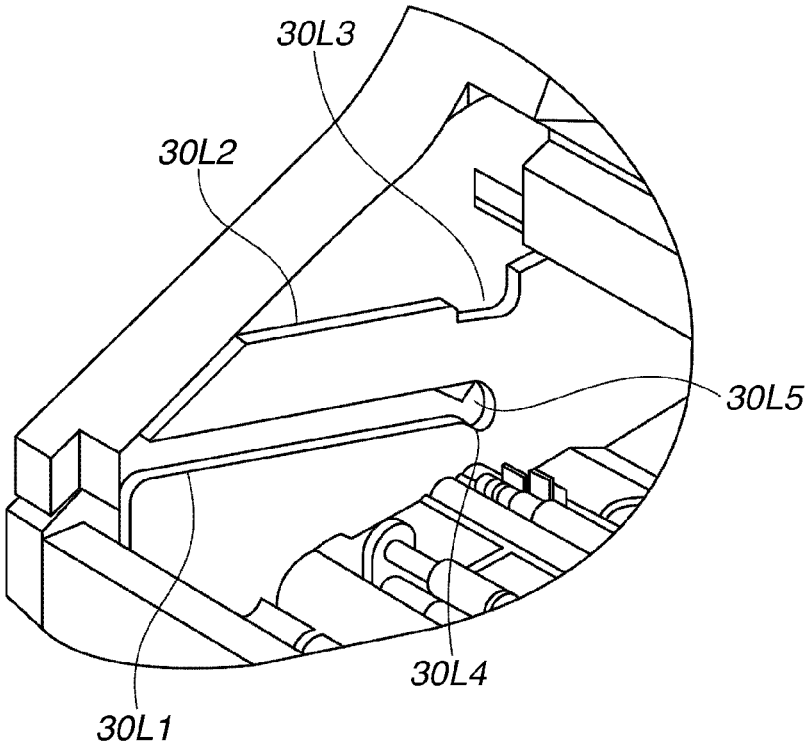
FIG. 4 is a perspective view of a main portion illustrating a mounting portion of the image forming apparatus, to which the process cartridge according to the exemplary embodiment of the present invention is mounted.
Figure 5:
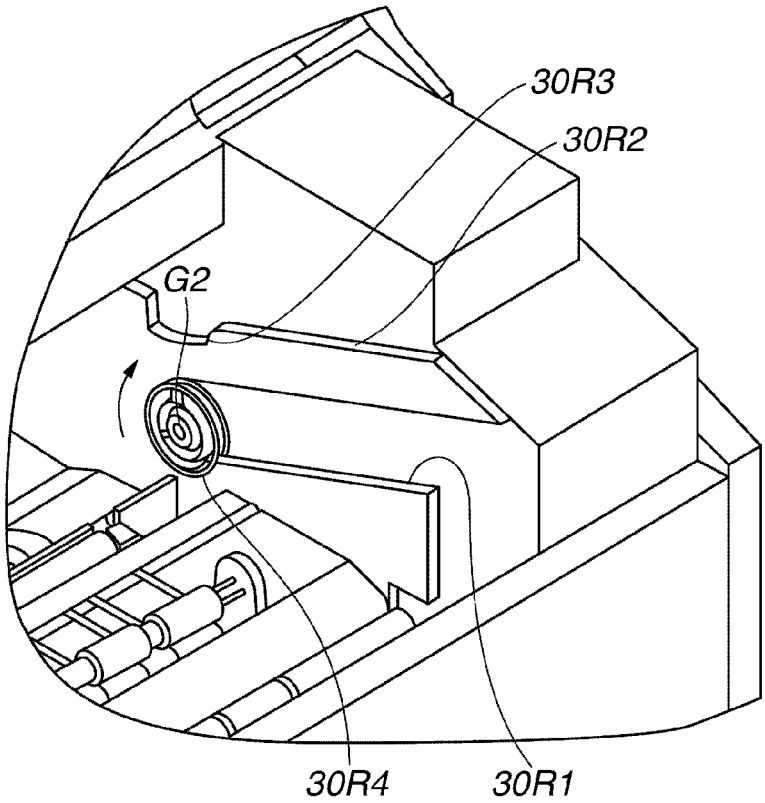
FIG. 5 is a perspective view of a main portion illustrating a mounting portion of the image forming apparatus, to which the process cartridge according to the exemplary embodiment of the present invention is mounted.

As illustrated in FIGS. 4 and 5, the cartridge mounting unit of the present exemplary embodiment includes guiding portions 30L1, 30L2, 30R1, and 30R2 formed in the image forming apparatus. When mounting the cartridge B to the apparatus body A, cylindrical portions 40R1, 40R2, 40L1, and 40L2 (refer to FIGS. 6 and 7) located on both lateral surfaces of the cartridge B are respectively inserted into the apparatus body A along guiding portions 30R1, 30R2, 30L1, and 30L2 of the apparatus body A. The cylindrical portions 40R1, 40R2, 40L1, and 40L2 respectively engage with guiding portions 30R4, 30R3, 30L4, and 30L3, which are cartridge mounting portions of the apparatus body A. The guiding portions 30R4, 30R3, 30L4, and 30L3 position the cartridge B relative to the apparatus body A. The cover 9 is closed to cover the opening 100 (closed position), which completes the mounting of the cartridge B to the apparatus body A.

Figure 6:
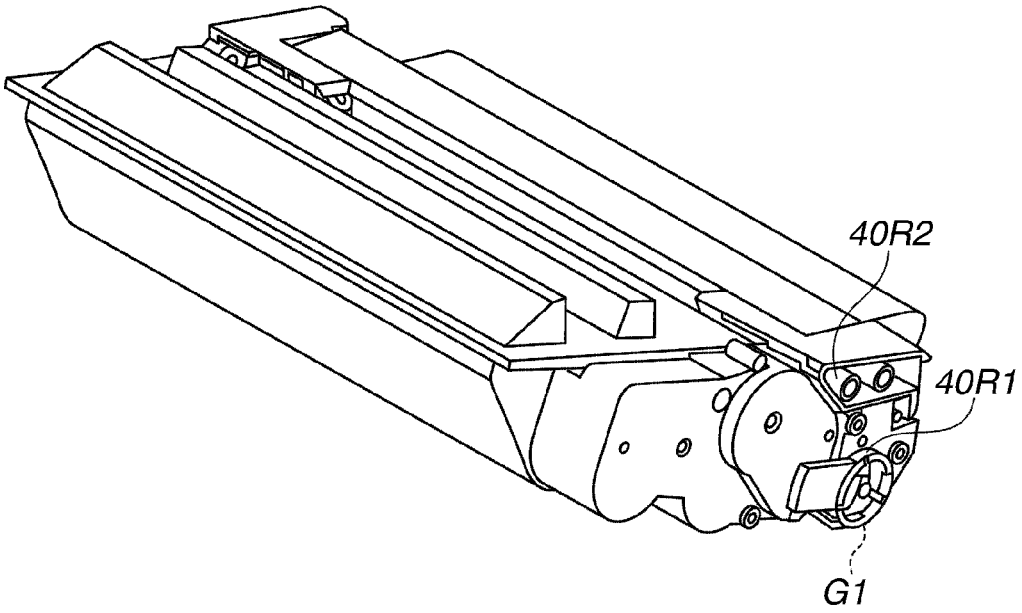
FIG. 6 is an external perspective view of the process cartridge according to the exemplary embodiment of the present invention.
Figure 7:
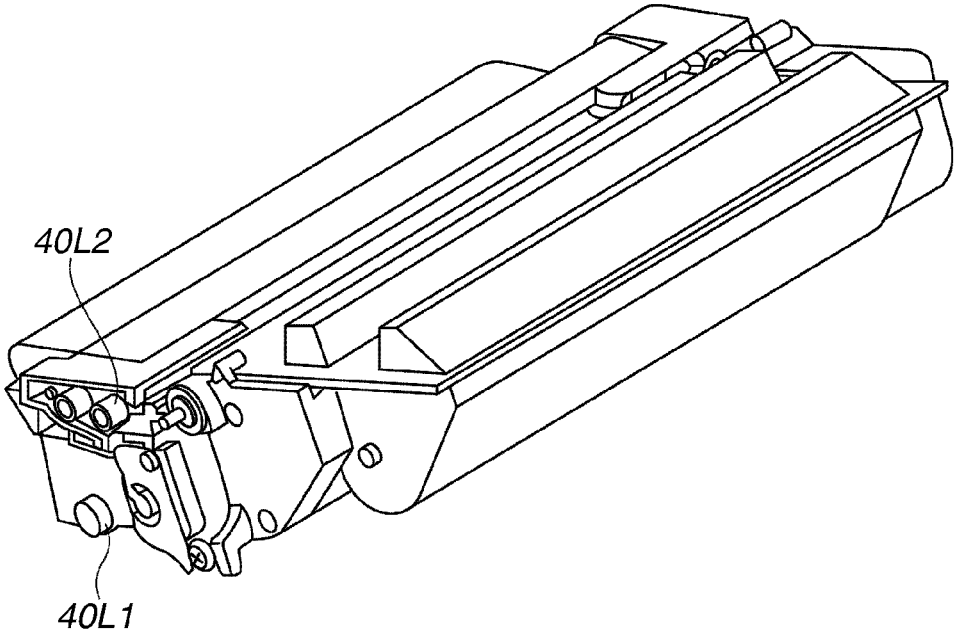
FIG. 7 is an external perspective view of the process cartridge according to the exemplary embodiment of the present invention.

As described above, the cartridge B is mounted to the guiding portions 30R4, 30R3, 30L4, and 30L3. As illustrated in FIGS. 5 and 6, a coupling G1, which is a driving force transmitting unit provided in one of the ends of the photosensitive drum 7 held by the cartridge B, engages with a coupling G2 provided in the apparatus body A. Then, as the coupling G2 rotates (in a direction indicated by an arrow in FIG. 5), the photosensitive drum 7 is rotated through the coupling G1 (in a direction indicated by an arrow G3 in FIG. 1). Thus, the driving force of the apparatus body A is transmitted to the cartridge B.

As the driving force is transmitted to the cartridge B, the cartridge B is subjected to a force that rotates the cartridge B in the clockwise direction (the direction indicated by the arrow G3 in FIG. 1), that is, the same direction as the rotational direction of the photosensitive drum 7. The cylindrical portion 40R2 (refer to FIG. 6) of the cartridge B is pressed toward a slanted surface 30R3 (refer to FIG. 5) of the apparatus body A by the force, and thereby the cylindrical portion 40R2 and the slanted surface 30R3 abut on each other. As a result, the position of the cartridge B relative to the apparatus body A becomes fixed.

As illustrated in FIG. 1, the track of the cartridge B as the cartridge B is mounted to the apparatus body A is represented by D1 on the entrance side from the mounting direction of the cartridge B relative to a horizontal line C of the apparatus body A. More specifically, the gradient angle of the track D1 relative to the horizontal line C is approximately 20 degrees. The track is represented by D2 on the back side in the mounting direction of the cartridge B. The gradient angle of the track D2 relative to the horizontal line C is approximately 60 degrees. The switching of the mounting direction of the cartridge B from the track D1 to the track D2 during the mounting of the cartridge B can inform a user that the process cartridge B has been surely mounted to the apparatus body A. Although the gradient angle of the track D1 and the gradient angle of the track D2 are approximately 20 degrees and 60 degrees, respectively, relative to the horizontal line C in the present exemplary embodiment, the angles are not limited thereto. The angles may be modified according to the recording medium conveyance path of the apparatus body A or the like.

Next, the structure of the frame of the cartridge B according to the exemplary embodiment of the present invention will be described. As illustrated in FIG. 2, the photosensitive drum 7, the charge roller 8, and the cleaning device 17 having the elastic cleaning blade 17*a*, etc., are attached to a drum frame 18. The drum frame 18 constitutes an integral photosensitive member unit 20.

Meanwhile, the developing device 19 includes a toner container 14 configured to store the toner, and a developing frame 13 configured to hold the developing roller 10 and the developing blade 12. The toner container 14 and the developing frame 13 are integrated by welding a flange portion 14*b* and a flange portion 13*b* to each other by means of welding or the like.

Figure 8:
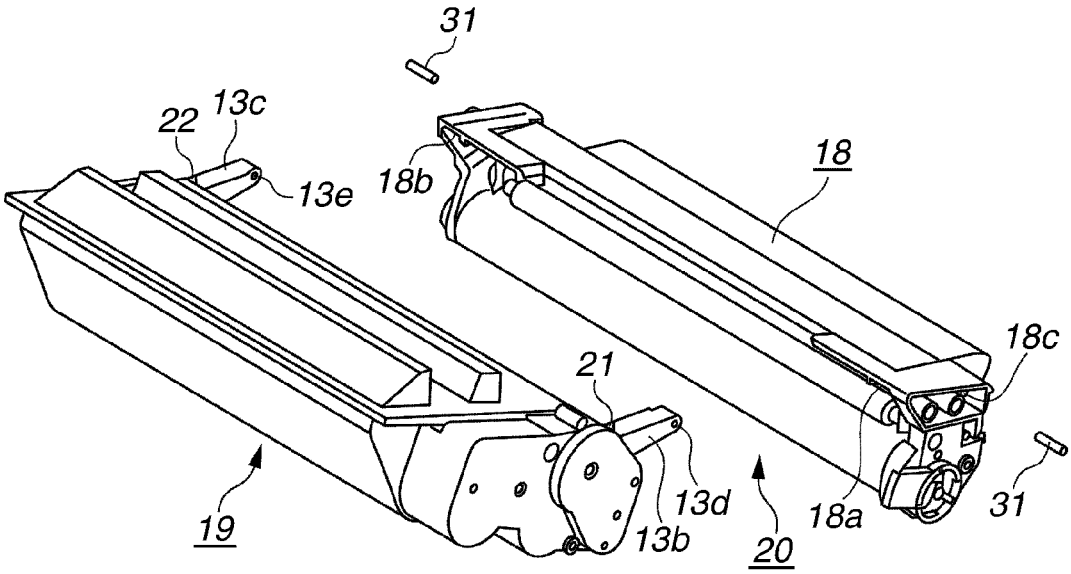
FIG. 8 is an external perspective view illustrating a structure of the process cartridge according to the exemplary embodiment of the present invention.

The photosensitive unit 20 and the developing device 19 are connected with each other by pins 31 as connecting members illustrated in FIG. 8, in such a way as to be able to pivot about the pins 31 relative to each other. Thereby, the cartridge B is constituted. More specifically, as illustrated in FIG. 8, rotation holes 13*d* and 13*e* are formed in tips of arm portions 13*b* and 13*c* provided at the longitudinal (a direction of an axial line of the developing roller 10) ends of the developing frame 13. The rotation holes 13*d* and 13*e* are parallel to the developing roller 10, and have a round shape.

The drum frame 18 has recesses 18*a* and 18*b* provided at the longitudinal ends of the drum frame 18. The arm portions 13*b* and 13*c* are respectively advanced into the recesses 18*a* and 18*b*. The arm portions 13*b* and 13*c* are respectively inserted into the recesses 18*a* and 18*b*. Then, the pins 31 are inserted into attaching holes 18*c* and 18*d* of the drum frame 18. The pins 31 are fitted into the rotation holes 13*d* and 13*e* of the arm portions 13*b* and 13*c*. The pins 31 are further pressed into inner holes (not illustrated) of the drum frame 18. As a result, the photosensitive member unit 20 and the developing device 19 are connected to each other, being able to pivot about the pins 31 relative to each other.

At this time, compression springs 21 and 22 attached to the base portions of the arm portions 13*b* and 13*c* are respectively pressed upon the top walls of the recesses 18*a* and 18*b* of the drum frame 18. The springs 21 and 22 press downward the developing device 19. Thereby, the developing roller 10 is surely kept pressed upon the photosensitive drum 7.

Next, referring to FIGS. 9A, 9B, 9C, 10, and 11, a memory unit (memory member) mounted in the cartridge B will be described.

A memory unit 60 mounted in the cartridge B is attached to the drum frame 18 of the cartridge B.

Figure 9A:
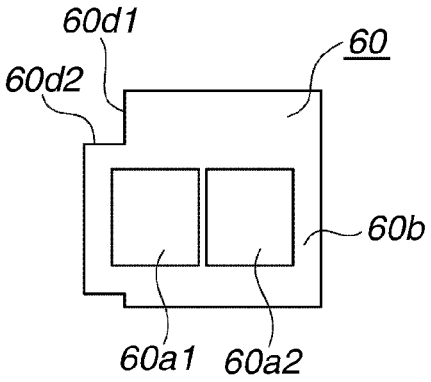
FIGS. 9A, 9B, and 9C illustrate a structure of a memory unit according to the exemplary embodiment of the present invention.
Figure 9B:
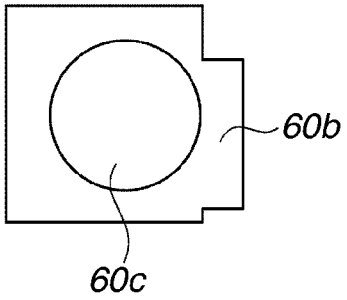
Figure 9C:
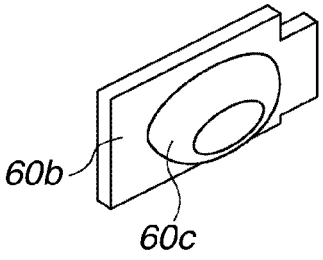

As illustrated in FIGS. 9A, 9B, and 9C, the memory unit 60 has memory unit contact portions 60*a*1 and 60*a*2 as a cartridge electrical contact on a substrate 60*b*. The memory unit 60 has a memory chip 60*c*, which is a storage element, such as a RAM or a ROM, which are on the opposite surface of the substrate 60*b* from the contact portions 60*a*1 and 60*a*2. FIGS. 9A, 9B, and 9C illustrate a state where the memory chip 60*c* is covered with a resin or the like.

The necessary information regarding the cartridge is stored in advance in the memory chip 60*c*. When the cartridge B is mounted to the mounting position in the apparatus body A, information is communicated between the memory chip 60*c* and the apparatus body A. A condition such as the use condition of the cartridge B is reported to a control chip (not illustrated) of the apparatus body A. The condition of the cartridge B is displayed for an operator based on the reported information, and a process unit is controlled. Because the memory chip 60*c* is writable even during the usage of the cartridge B, the information is written into the memory chip 60*c* any time as necessary. Here, the information regarding the cartridge means the lot number, initial values for the processing conditions, use condition, etc., of the process cartridge, the characteristics of the image forming apparatus, and the characteristics of the processing unit, etc.

The contact portions 60*a*1 and 60*a*2 are electrically connected to a body electrical contact 54 (refer to FIG. 11) provided in the apparatus body A, in order to write information into the memory chip 60*c*. The contact portions 60*a*1 and 60*a*2 are contacts plated with nickel and gold, and are mounted to the substrate 60*b*.

Figure 10A:
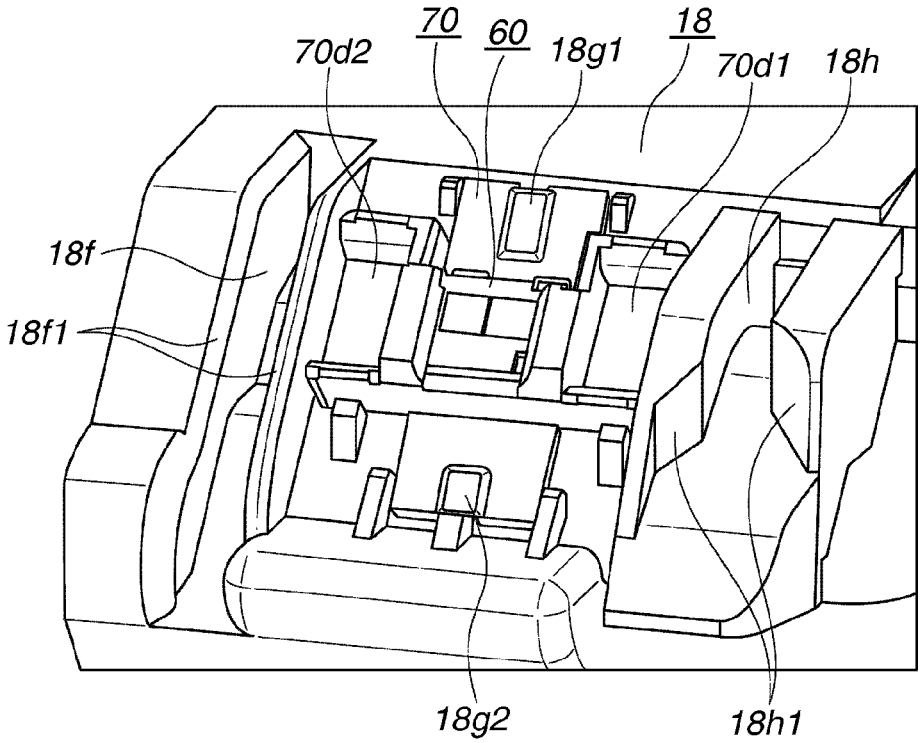
FIGS. 10A and 10B illustrate an attaching position of the memory unit according to the exemplary embodiment of the present invention.
Figure 10B:
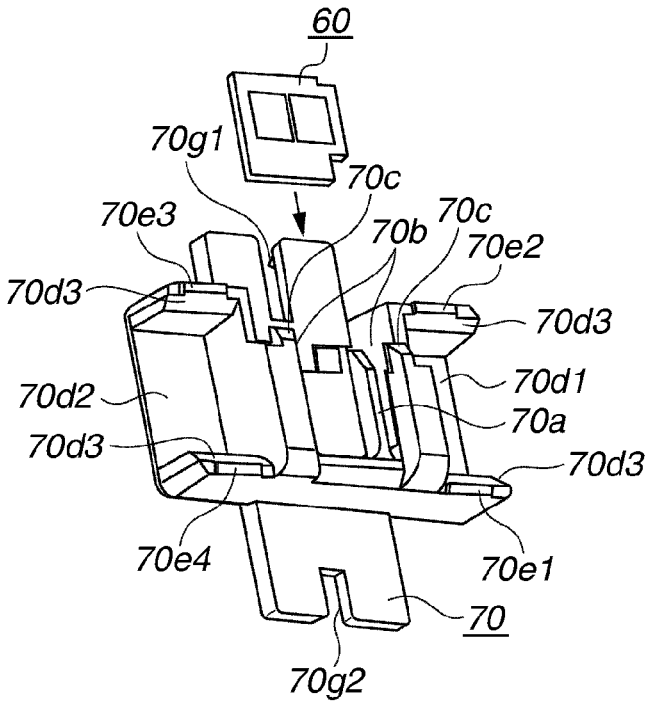
Figure 11:
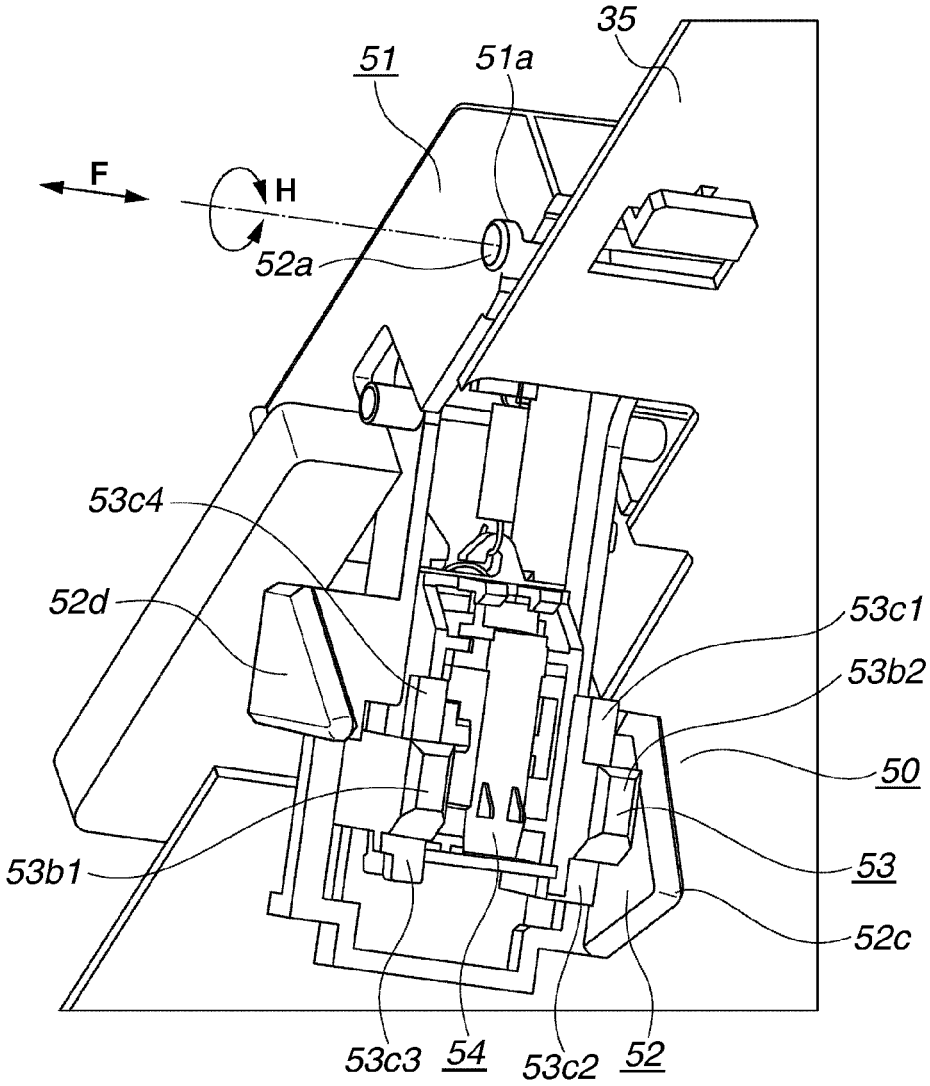
FIG. 11 is a perspective view illustrating a structure of an electrical contact of the image forming apparatus according to the exemplary embodiment of the present invention.

FIG. 10A illustrates a state where the memory unit 60 is attached to the drum frame 18. FIG. 10B illustrates a condition in which the memory unit 60 is attached to a memory unit attaching base 70. FIG. 11 illustrates a condition in which a housing 51 which is a movable contact holding member 50, a first holding member 52, a second holding member 53, and a body electrical contact (connector) 54 are attached. The first holding member 52 and the second holding member 53 constitute a body supporting member configured to support the body electrical contact.

The drum frame 18 has a first engaging portion 18*h*, which is next to the memory unit attaching base 70 attached to the drum frame 18. The first engaging portion 18*h* controls the position (the longitudinal position of the photosensitive drum 7) of an engaging portion 52*d* of the first holding member (first body supporting member) 52 of the movable contact holding member 50 provided in the apparatus body A according to the inserting position of the cartridge B. The first engaging portion 18*h* is in the form of a groove. Here, the first engaging portion 18*h* is provided with a chamfered portion 18*h*1 provided in the entrance portion of the holding member. Thereby, the engaging portion 52*d* is easily and correctly guided in a predetermined direction. The drum frame 18 has a second engaging portion 18*f* on the opposite side in the longitudinal direction across the memory unit attaching base 70.

The second engaging portion 18*f* controls the position (the longitudinal position of the photosensitive drum) of an engaging portion 52*c* of the first holding member (first body supporting member) 52. Here, the second engaging portion 18*f* is in the form of a groove. The second engaging portion 18*f* is provided with a slanted surface 18*f*1 provided in the entrance portion of the holding member. Thereby, the engaging portion 52*c* tends to be correctly guided in a predetermined direction.

Here, the play between the first engaging portion 18*h* and the engaging portion 52*d* (first body engaging portion) is set to be greater than the clearance (play) between the second engaging portion 18*f* and the engaging portion 52*c* (second body engaging portion) in a state where the second engaging portion 18*f* engages with the engaging portion 52*c*.

The memory unit attaching base 70 attached to the drum frame 18 of the cartridge B has third engaging portions 70*d*1 and 70*d*2. The third engaging portions 70*d*1 and 70*d*2 controls the positions of engaging portions 53*b*1 and 53*b*2 of the second holding member 53 of the movable contact holding member 50 provided in the apparatus body A (a direction intersectional to the positioning direction of the second engaging portion 18*f*).

The third engaging portions 70*d*1 and 70*d*2 are in the form of a groove. A slanted surface 70*d*3 is provided in the inserting direction of the engaging portions 53*b*1 and 53*b*2 of the second holding member (second body supporting member) 53 at the tip portions of the third engaging portions 70*d*1 and 70*d*2. The structure makes it easier for the engaging portions 53*b*1 and 53*b*2 of the second holding member 53 to be guided.

The memory unit attaching base 70 has regulating portions 70*e*1, 70*e*2, 70*e*3, and 70*e*4. The regulating portions 70*e*1, 70*e*2, 70*e*3, and 70*e*4 control the positions of abutting portions 53*c*1, 53*c*2, 53*c*3, and 53*c*4 of the second holding member 53 of the movable contact holding member 50 provided in the apparatus body A. The positions of the abutting portions 53*c*1, 53*c*2, 53*c*3, and 53*c*4 in a direction perpendicular to the memory unit contact portions 60*a*1 and 60*a*2 of the memory unit 60 are controlled by the regulating portions 70*e*1, 70*e*2, 70*e*3, and 70*e*4.

The functions of the first engaging portion 18*h*, the second engaging portion 18*f*, the third engaging portions 70*d*1 and 70*d*2, and the regulating portions 70*e*1, 70*e*2, 70*e*3 and 70*e*4 will be described below in detail.

Next, the structure of a connecting unit of an electrical contact member provided in the apparatus body A will be described referring to FIGS. 1, 11, 12A, 12B, and 12C.

As illustrated in FIG. 1, the movable contact holding member 50 as the connecting unit is positioned so that the movable contact holding member 50 is located opposite the memory unit 60 when the cartridge B is mounted to the apparatus body A. As illustrated in FIGS. 11, 12A, 12B, and 12C, the movable contact holding member 50 has the housing 51, the first holding member 52, the second holding member 53, and the body electrical contact (connector) 54.

The housing 51 is arranged in frame portion 35 configured to hold the optical device 1. The housing 51 has engaging portions 51*a*, which engage with an axis portion 52*a*, which is a rotational axle of the first holding member 52. The first holding member 52 is rotatably attached to the housing 51 as indicated by an arrow H in FIG. 11. The first holding member 52 is attached with the presence of some play between the engaging portions 51*a* provided at the longitudinal ends of the housing 51 (refer to FIG. 12B). As a result, the first holding member 52 is able to move relative to the housing 51 in a direction indicated by an arrow F in FIG. 11. The direction indicated by the arrow F is the same direction as the longitudinal direction of the photosensitive drum 7 after mounting of the cartridge B to the apparatus body A.

Figures 12A, 12B, 12C:
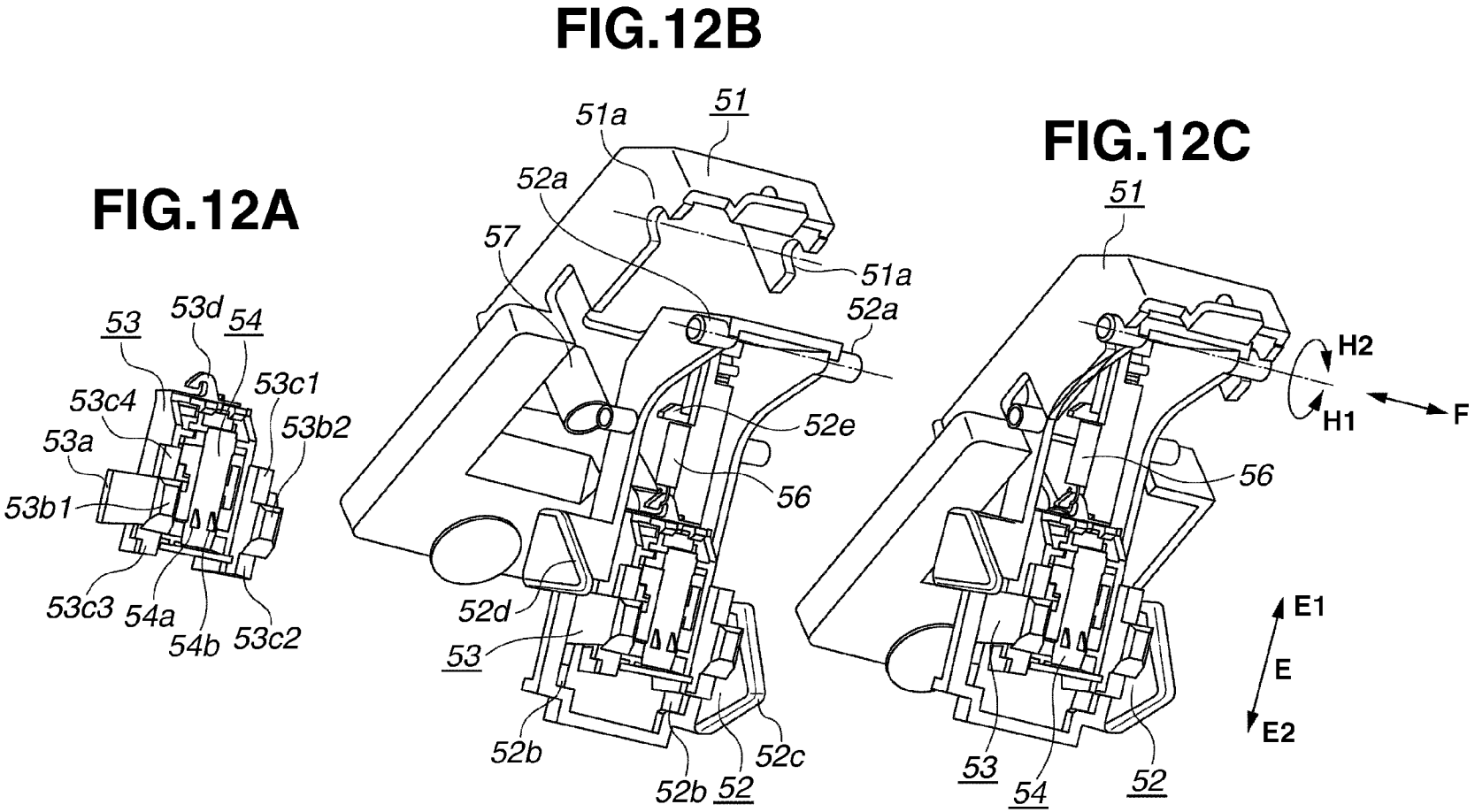
FIGS. 12A, 12B, and 12C are perspective views illustrating structures of electrical contacts of the image forming apparatus according to the exemplary embodiment of the present invention.

As illustrated in FIG. 12A, the body electrical contact 54 holds body electrical contact portions 54*a* and 54*b*, which are springy members. The body electrical contact portions 54*a* and 54*b* are electrically connected to the control chip (not illustrated) provided on the apparatus body A side through a bundle of wires (not illustrated). The body electrical contact 54 is attached to the second holding member 53.

A rib 53*a* of the second holding member 53 is guided by guiding portions 52*b* of the first holding member 52 (refer to FIG. 12B), and thereby the second holding member 53 is able to move relative to the housing 51 in a direction indicated by an arrow E in FIG. 12C. An extension spring 56 is attached to a spring hook portion 53*d* of the second holding member 53 and a spring hook portion 52*e* of the first holding member 52, thereby urging the first holding member 52 and the second holding member 53 to a side E1 (refer to FIG. 12C) in the direction indicated by the arrow E. The direction indicated by the arrow E is approximately perpendicular (intersectional) to the direction indicated by the arrow F. In other words, the direction indicated by the arrow E is approximately perpendicular (intersectional) to the longitudinal direction of the photosensitive drum 7. A compression spring 57 is arranged between the first holding member 52 and the housing 51, thereby urging the first holding member 52 in a direction indicated by an arrow H1 (refer to FIG. 12C).

As described above, the body electrical contact 54 is enabled, by the structure of the movable contact holding member 50, to move in the directions indicated by the arrows E, F, and H. When the cartridge B is not in the mounting position of the apparatus body A (a home position of the movable contact holding member 50), the first holding member 52 is urged to the side H1, and the second holding member 53 is urged to the side E1.

Next, referring to FIGS. 1, 13, 14A1, 14A2, 14A3, 14B1, 14B2, 14B3, 14C1, 14C2, 14C3, 14D1, 14D2, and 14D3, the structure in which the body electrical contact portions 54*a* and 54*b* of the body electrical contact 54 are connected to the electrical contact portions 60*a*1 and 60*a*2 as the cartridge electrical contact will be described.

As illustrated in FIG. 1, the track of the cartridge B as the cartridge B is mounted to the apparatus body A is has a gradient angle of approximately 20 degrees on the entrance side from the mounting direction of the cartridge B relative to the horizontal line C of the apparatus body A (track D1). The track has a gradient angle of approximately 60 degrees on the back side (track D2).

Figure 13:
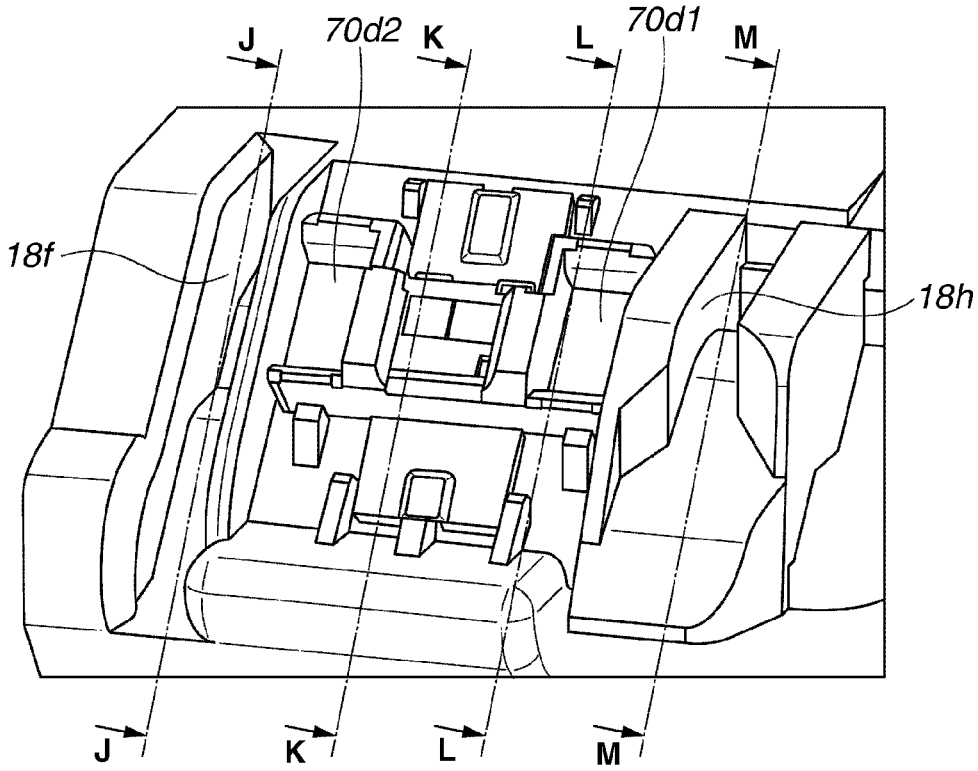
FIG. 13 illustrates an attaching position of the memory unit according to the exemplary embodiment of the present invention.

FIG. 13 illustrates a sectional position in each of sectional views illustrated in FIGS. 14A1, 14A2, 14A3, 14B1, 14B2, 14B3, 14C1, 14C2, 14C3, 14D1, 14D2, and 14D3. FIGS. 14A1, 14A2, 14A3, 14B1, 14B2, 14B3, 14C1, 14C2, 14C3, 14D1, 14D2, and 14D3 illustrate states of portions in the mounting state of the cartridge B.

In FIG. 13, the movable contact holding member 50 is omitted. FIGS. 14A1, 14A2, 14A3, 14B1, 14B2, 14B3, 14C1, 14C2, 14C3, 14D1, 14D2, and 14D3 illustrate also the state of the movable contact holding member 50 in the mounting state of the cartridge B. The states illustrated in FIGS. 14A1, 14B1, 14C1, and 14D1, FIGS. 14A2, 14B2, 14C2, and 14D2, and FIGS. 14A3, 14B3, 14C3, and 14D3 sequentially illustrate a condition where the cartridge B is mounted to the apparatus body A by the user. FIGS. 14A1, 14A2, and 14A3 illustrate sections of the second engaging portion 18*f*, taken along line J-J in FIG. 13. FIGS. 14B1, 14B2, and 14B3 illustrate sections of the cartridge electrical contact portion 60*a*2, taken along line K-K in FIG. 13. FIGS. 14C1, 14C2, and 14C3 illustrate sections of the third engaging portion 70*d*1, taken along line L-L in FIG. 13. FIGS. 14D1, 14D2, and 14D3 illustrate sections of the first engaging portion 18*h*, taken along line M-M in FIG. 13.

First, the states illustrated in FIGS. 14A1, 14B1, 14C1, and 14D1 will be described.

The engaging portion 52*d* of the first holding member (first body supporting member) 52 begins to engage with the first engaging portion 18*h*. At this time, the movable contact holding member 50 relative to the drum frame 18 in the longitudinal direction of the photosensitive drum 7 begins to be temporarily positioned (roughly guided). A tip portion 52*d*1 of the engaging portion 52*d* abuts on a bottom face 18*h*2 of a groove portion of the first engaging portion 18*h*. The bottom face 18*h*2 has a cam shape, and pushes up the first holding member 52 to a direction indicated by an arrow H2 (a direction resisting the urging direction of the compression spring 57) in FIG. 12C. At this time, as illustrated in FIG. 14A1, the engaging portion 52*c* of the first holding member 52 does not engage with the second engaging portion 18*f*. As illustrated in FIG. 14C1, the engaging portion 53*b*1 of the second holding member 53 does not engage with the third engaging portion 70*d*1. Furthermore, as illustrated in FIG. 14B1, the body electrical contact portion 54*a* is not connected to the electrical contact portion 60*a*1 which is the cartridge electrical contact.

Next, in the states illustrated in FIGS. 14A2, 14B2, 14C2, and 14D2, the cartridge B is inserted deeper into the apparatus body A, compared to the states illustrated in FIGS. 14A1, 14B1, 14C1, and 14D1. The engaging portion 52*d* of the first holding member 52 engages with the first engaging portion 18*h*, thereby temporarily positioning the movable contact holding member 50 in the longitudinal direction of the photosensitive drum 7. Then, as illustrated in FIG. 14A2, the engaging portion 52*c* of the first holding member 52 engages with the second engaging portion 18*f*, thereby positioning the movable contact holding member 50 in the longitudinal direction.

Because the play between the second engaging portion 18*f* and the engaging portion 52*c* is set to be smaller than the play between the first engaging portion 18*h* and the engaging portion 52*d*, the movable contact holding member 50 is positioned in the longitudinal direction after the movable contact holding member 50 is temporarily positioned (roughly guided) in the longitudinal direction. The structure is employed, and thereby the first holding member (first body supporting member) 52 having the body electrical contact surely engages with the drum frame 18 even when the cartridge B is obliquely mounted to the apparatus body A as described below. However, at this time point, as illustrated in FIG. 14C2, the engaging portion 53*b*1 of the second holding member 53 does not yet engage with the third engaging portion 70*d*1. As illustrated in FIG. 14B2, the body electrical contact portion 54*a* is not yet connected to the electrical contact portion 60*a*1, which is the cartridge electrical contact.

FIGS. 14A3, 14B3, 14C3, and 14D3 illustrate states where the mounting of the cartridge B to the mounting position provided in the apparatus body A by the user has just been completed. In other words, in the present exemplary embodiment, as illustrated in FIGS. 4 to 7, the cylindrical portions 40R1 and 40R2 respectively engage with the guiding portions 30R4 and 30R3, and the cylindrical portions 40L1 and 40L2 respectively engage with the guiding portions 30L4 and 30L3. Because the transfer roller 4 is pressed against the photosensitive drum 7 by a spring (not illustrated) in the mounting position, a cartridge urging spring 30L5 prevents the cylindrical portion 40L1 from getting loose from the guiding portion 30L4. When the longitudinal opposite side cylindrical portion 40R1 engages with the guiding portion 30R4, the coupling G1 and the coupling G2 are brought into an engageable state. Here, the cylindrical portion 40R1, the cylindrical portion 40R2, the cylindrical portion 40L1, and the cylindrical portion 40L2 are provided in the cartridge B. The guiding portion 30R1, the guiding portion 30R2, the guiding portion 30R3, the guiding portion 30R4, the guiding portion 30L1, the guiding portion 30L2, the guiding portion 30L3, and the guiding portion 30L4 are provided in the apparatus body A.

FIG. 14A3 illustrates a state where the engagement of the engaging portion 52*c* of the first holding member 52 with the second engaging portion 18*f* is completed, thereby positioning the first holding member 52 in the longitudinal direction. As illustrated in FIG. 14C3, the engaging portion 53*b*1 of the second holding member 53 engages with the third engaging portion 70*d*1. As illustrated in FIG. 12C, the second holding member 53 is attached to the housing 51 with the second holding member 53 urged to the arrow E1 side by the extension spring 56. Consequently, the engaging portion 53*b*1 of the second holding member 53 engages with the third engaging portion 70*d*1 along the slanted surface 70*d*3 and a surface 70*d*4. More specifically, the engaging portion 53*b*1 engages with the third engaging portion 70*d*1 while moving to an arrow E2 side in FIG. 12C. The positioning is carried out in the direction intersecting with the longitudinal direction by the engagement. After the positioning, the body electrical contact portions 54*a* and 54*b* are electrically connected to the electrical contact portions 60*a*1 and 60*a*2, respectively.

As described above, the compression spring 57 is arranged between the first holding member 52 and the housing 51, thereby urging the first holding member 52 in the H1 direction (refer to FIG. 12C). The spring pressure of the compression spring 57 is set to a value greater than the value of the sum of the spring pressures of the body electrical contact portions 54*a* and 54*b*. Therefore, desired contact pressure can be always ensured between the body electrical contact portions 54*a* and 54*b* and the electrical contact portions 60*a*1 and 60*a*2.

As illustrated in FIG. 14D3, the tip portion 52*d*1 of the engaging portion 52*d* of the first holding member 52 is separated (moved away) from the bottom face 18*h*2 of the groove portion of the first engaging portion 18*h*. Simultaneously with or after the separation, as illustrated in FIG. 14C3, the engaging portion 53*b*1 of the second holding member 53 engages with the third engaging portion 70*d*1. Furthermore, the abutting portions 53*c*3 and 53*c*4 of the second holding member 53 are positioned to abut on the regulating portions 70*e*1 and 70*e*2 of the cartridge B. Therefore, desired contact pressure can be always maintained.

When the cartridge B is removed from the apparatus body A, the movable contact holding member 50 is separated from the drum frame 18 in the inverse state to the order described above.

In the present exemplary embodiment, the first holding member 52 is temporarily positioned (roughly guided) in the longitudinal direction by the first engaging portion 18*h* of the drum frame 18 during the track of the cartridge B as the cartridge B is mounted to the apparatus body A. After the mounting of the cartridge B to the apparatus body A is further advanced, the first holding member 52 engages with the second engaging portion 18*f* of the drum frame 18, thereby positioning the first holding member 52 in the longitudinal direction.

Almost as soon as the first holding member 52 begins to be temporarily positioned (roughly guided) in the longitudinal direction by the first engaging portion 18*h*, the tip portion 52*d*1 of the engaging portion 52*d* abuts on the cam of the bottom face 18*h*2 of the first engaging portion 18*h*. Thereby, the first holding member 52 begins to be pushed up in the H2 direction (the direction resisting the urging direction of the compression spring 57) in FIG. 12C. The curvature of the cam shape is desirably increased as much as possible so that the mounting force of the cartridge B is not increased by the urging force of the compression spring 57. Therefore, the cam is arranged on the bottom face 18*h*2 of the first engaging portion 18*h*, which first begins to be engaged when the cartridge B is mounted.

After the mounting is further advanced, the second holding member 53 engages with the third engaging portion 70*d*1 of the drum frame 18. Thereby, the cartridge electrical contact (electrical contact portions 60*a*1 and 60*a*2), and the body electrical contact 54 are positioned in the direction approximately perpendicular (intersectional) to the direction in which the first holding member 52 is movable (the direction indicated by the arrow F, which is the longitudinal direction of the photosensitive drum 7). The engagement between the second holding member 53 and the drum frame 18 occurs before the electrical connection is established between the electrical contact portions 60*a*1 and 60*a*2 and the body electrical contact 54.

According to the above-described structure, when the body electrical contact portions 54*a* and 54*b* and the electrical contact portions 60*a*1 and 60*a*2 slide on (wipe) each other, the body electrical contact portions 54*a* and 54*b* do not move in the longitudinal direction of the photosensitive drum 7. Therefore, contact pressure is surely generated between the body electrical contact portions 54*a* and 54*b* and the electrical contact portions 60*a*1 and 60*a*2 in a bending direction (a direction in which the body electrical contact portions 54*a* and 54*b* press on the electrical contact portions 60*a*1 and 60*a*2 respectively). Therefore, the cartridge electrical contact (electrical contact portions 60*a*1 and 60*a*2) can be connected to the body electrical contact 54 in a stable state.

After the cartridge electrical contact and the body electrical contact 54 are positioned in the direction approximately perpendicular (intersectional) to the longitudinal direction of the photosensitive drum 7, the body electrical contact 54 is connected to the cartridge electrical contact (electrical contact portions 60*a*1 and 60*a*2). Therefore, the cartridge electrical contact (electrical contact portions 60*a*1 and 60*a*2) can be reduced in size, making it possible to reduce the cost of the memory unit 60.

Next, engagement between the first holding member 52 and the drum frame 18 when the cartridge B is obliquely mounted to the apparatus body A will be described referring to FIGS. 15A, 15B, 15C, and 15D. The engaging portions 53*b*1 and 53*b*2 of the second holding member 53 and the third engaging portions 70*d*1 and 70*d*2 of the drum frame 18 are omitted from the illustrations in order to simplify the description in FIGS. 15A, 15B, 15C, and 15D.

Figure 15A:
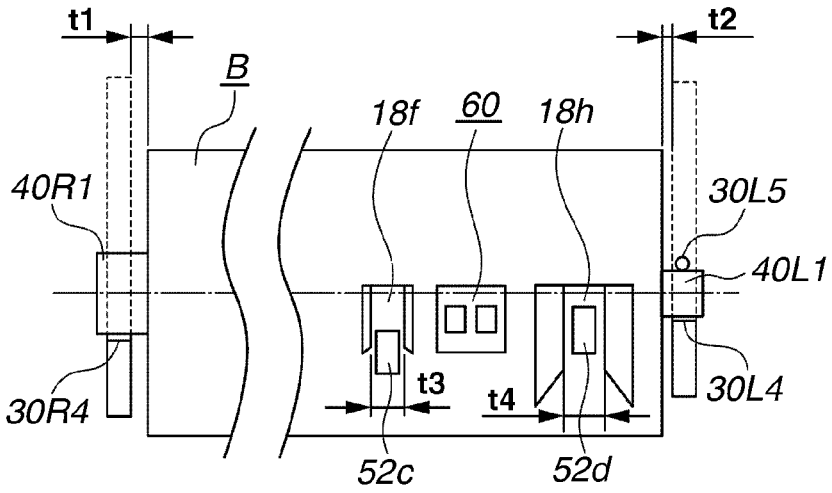
FIGS. 15A, 15B, 15C, and 15D illustrate mounting states of the process cartridge according to the exemplary embodiment of the present invention.

FIG. 15A illustrates a state where the mounting of the cartridge B to the mounting position provided in the apparatus body A is completed by the user. Therefore, as described above, the cylindrical portions 40R1 and 40L1 respectively engage with the guiding portions 30R4 and 30L4. In order to prevent the cylindrical portion 40L1 from getting loose from the guiding portion 30L4, the cylindrical portion 40L1 is urged by the cartridge urging spring 30L5. The engaging portion 52*d* of the first holding member 52 is temporarily positioned (roughly guided) in the longitudinal direction by the first engaging portion 18*h* of the drum frame 18. In addition, the engaging portion 52*c* of the first holding member 52 engages with the second engaging portion 18*f* of the drum frame 18, and is positioned in the longitudinal direction.

Figure 16:
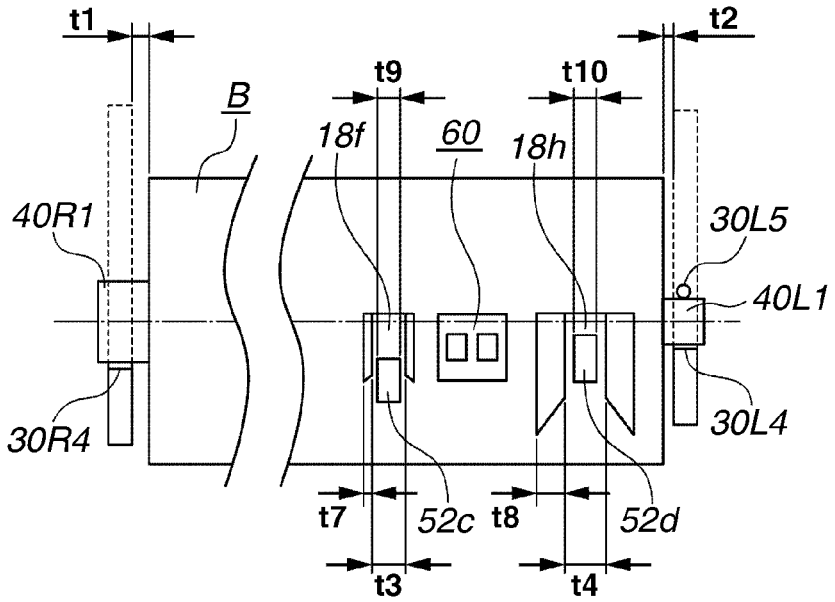
FIG. 16 is a sectional view illustrating an attaching position of the memory unit according to the exemplary embodiment of the present invention.

Similarly, FIG. 16 illustrates a state where the positioning is carried out in the longitudinal direction. Here, a width of the engaging portion 52*c* of the first holding member 52 is defined as t9, and a width of the engaging portion 52*d* of the first holding member 52 is defined as t10. In the state where the body supporting member engages with the second engaging portion, a clearance (t4−t10) between the first engaging portion and the first body engaging portion is greater than a clearance (t3−t9) between the second engaging portion and the second body engaging portion. In other words, the relation of (t4−t10)>(t3−t9) holds.

In light of dispersion of component sizes and a difference between coefficients of linear expansion caused by a material difference of a component in the apparatus body A and the cartridge B, proper play (clearance) is required between the apparatus body A and the cartridge B in the longitudinal direction of the cartridge B. The play of the present exemplary embodiment is obtained by summing t1 and t2 in FIG. 15A. It is necessary to set an amount of play to be greater because the dispersion of the component sizes and the difference between the coefficients of linear expansion is increased in the long cartridge. However, the cartridge B may be slanted by the play when the cartridge B is mounted to the apparatus body A.

Next, the engagement between the first holding member 52 and the drum frame 18 when the cartridge B is obliquely mounted to the apparatus body A in FIGS. 15B and 15D will be described.

Figure 15B:
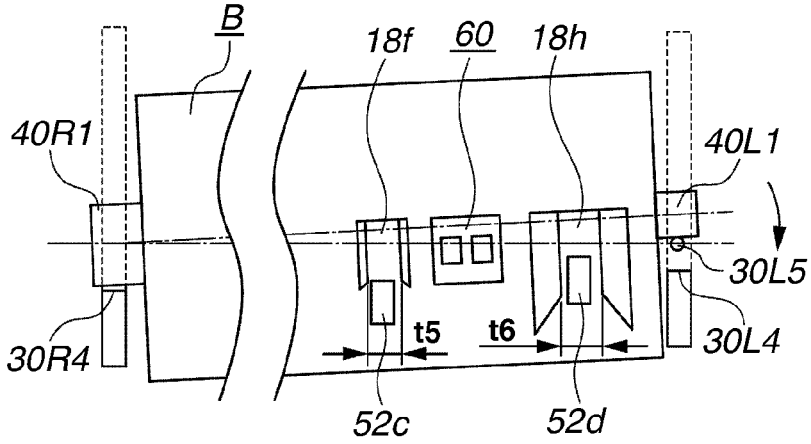

FIG. 15B illustrates a state where the cylindrical portion 40R1 engages with the guiding portion 30R4. Meanwhile, the opposite side cylindrical portion 40L1 is stopped before the cartridge urging spring 30L5, and the cylindrical portion 40L1 cannot engage with the guiding portion 30L4. In this state, the engaging portion 52*d* of the first holding member 52 is temporarily positioned (roughly guided) in the longitudinal direction by the first engaging portion 18*h* of the drum frame 18. However, the engaging portion 52*c* of the first holding member 52 does not engage with the second engaging portion 18*f* of the drum frame 18. When the cartridge B is mounted by the user, the state of FIG. 15B is changed to the state of FIG. 15A. The engaging portion 52*c* of the first holding member 52 engages with the second engaging portion 18*f* of the drum frame 18, thus positioning the first holding member 52 in the longitudinal direction.

FIG. 16 illustrates chamfered portions of the engaging portion 52*c* of the first holding member 52 and the engaging portion 52*d* of the first holding member 52. A width (t8) of a chamfered portion 18*h*1 of the engaging portion 52*d* (first engaging portion 18*h*) of the first holding member 52 is greater than a width (t7) of a chamfered portion 18*f*1 of the engaging portion 52*c* (second engaging portion 18*f*) of the first holding member 52. This is because a range where the temporary positioning (rough guiding) is enabled in the longitudinal direction is enlarged. When the position is determined to some extent by the temporary positioning, the gap after that is reduced, and thereby the chamfered portion can be also decreased.

Figure 15C:
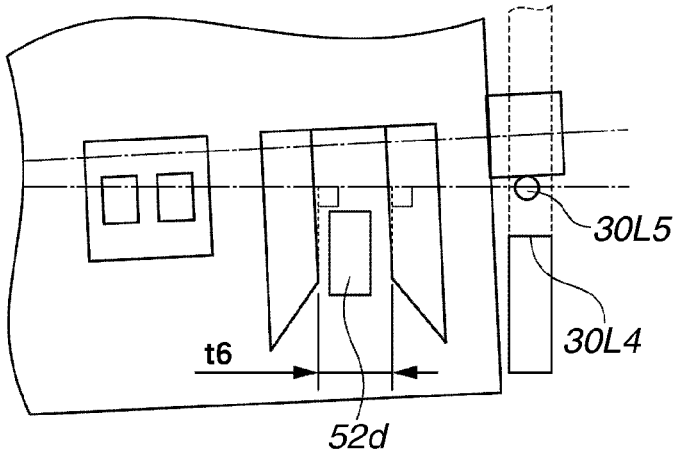
Figure 15D:
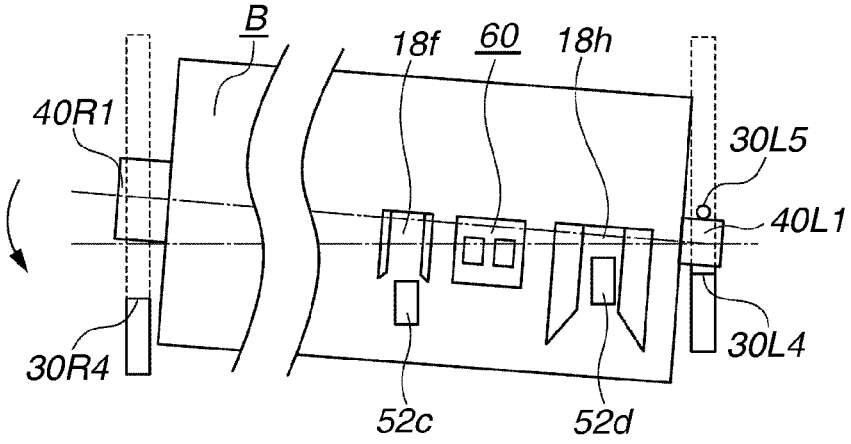

FIG. 15D illustrates an oblique mounting state opposite to that of FIG. 15B. At this time, the cylindrical portion 40R1 cannot engage with the guiding portion 30R4. The cylindrical portion 40L1 engages with the guiding portion 30L4. In this state, the engaging portion 52*d* of the first holding member 52 is temporarily positioned (roughly guided) in the longitudinal direction by the first engaging portion 18*h* of the drum frame 18. However, the engaging portion 52*c* of the first holding member 52 does not engage with the second engaging portion 18*f* of the drum frame 18. When the cartridge B is mounted by the user, the state of FIG. 15B is changed to the state of FIG. 15A. The engaging portion 52*c* of the first holding member 52 engages with the second engaging portion 18*f* of the drum frame 18, thus positioning the first holding member 52 in the longitudinal direction.

As described above, the engaging portion 52*d* of the first holding member 52 first engages with the first engaging portion 18*h* of the drum frame 18 in any case where the cartridge B is obliquely mounted to the apparatus body A (the state in FIG. 15B and the state in FIG. 15D).

The first engaging portion 18*h* and the second engaging portion 18*f* are located opposite each other in the longitudinal direction across the cartridge electrical contact (electrical contact portions 60*a*1 and 60*a*2). The first engaging portion 18*h* is provided in the end of the cartridge B in the longitudinal direction. Even when the cartridge B is obliquely mounted to the apparatus body A without enlarging the first engaging portion 18*h* of the drum frame 18 in the inserting direction of the cartridge B, first, the structure enables the engagement between the engaging portion 52*d* of the first holding member 52 and the first engaging portion 18*h*.

Furthermore, the reason for providing the first engaging portion 18*h* in the end of the cartridge B in the longitudinal direction will be described referring to FIGS. 15A and 15B. As described above, FIG. 15A illustrates the state where the mounting of the cartridge B to the mounting position provided in the apparatus body A is completed. Sizes t3 and t4 of the second engaging portion 18*f* and the first engaging portion 18*h* as viewed from a direction perpendicular to the longitudinal direction are illustrated in FIG. 15A. Sizes t5 and t6 of the second engaging portion 18*f* and the first engaging portion 18*h* as viewed from a direction perpendicular to the longitudinal direction in the state where the cartridge is obliquely mounted are illustrated in FIGS. 15B and 15C. The following relation is set when the state of FIG. 15A is compared with the states of FIGS. 15B and 15C.

$$(t4-t6)>(t3-t5)$$

More specifically, it is found that the change amount of the size of the end of the cartridge B in the longitudinal direction is greater than that of the cartridge B as viewed from the direction perpendicular to the longitudinal direction.

From the above-mentioned reason, the first engaging portion 18*h* temporarily positioned (roughly guided) in the longitudinal direction is desirably arranged in the end of the cartridge B in the longitudinal direction.

As a result, the first engaging portion 18*h* is temporarily positioned (roughly guided) in the longitudinal direction, and the engaging portion 52*c* of the first holding member 52 then engages with the second engaging portion 18*f* of the drum frame 18, thus positioning the first holding member 52 in the longitudinal direction. Therefore, sure engagement is enabled.

To describe in more detail, the engagement of the second engaging portion 18*f* of the drum frame 18 is arranged inside the first engaging portion 18*h* in the longitudinal direction, and thereby the change amount of the size of the second engaging portion 18*f* as viewed from the direction perpendicular to the longitudinal direction is small. Therefore, because the clearance between the engaging portion 52*c* and the second engaging portion 18*f* in the longitudinal direction can be set to be small, longitudinal positioning accuracy can be improved. As a result, the first holding member 52 (body supporting member) having the body electrical contact 54 surely engages with the drum frame 18 of the cartridge B. Therefore, the body electrical contact 54 can be surely connected to the cartridge electrical contact (electrical contact portions 60*a*1 and 60*a*2) in a stable state.

When the cartridge B is removed from the apparatus body A, the cartridge B is pulled out in a state opposite to the order described above. The engagement of the engaging portion 52*d* of the first holding member 52 can be immediately released from the first engaging portion 18*h* of the drum frame 18, and thereby catching or the like caused by a prying motion of the engaging portion 52*d* does not occur. Therefore, a pulling force when the cartridge B is pulled out from the apparatus body A is not increased.

A temporary positioning size (an engagement size of the engaging portion 52*d* of the first holding member 52 and the first engaging portion 18*h* of the drum frame 18) has no size relation such that the cartridge B is stretched within the engaging portion even when the cartridge B is slanted within the apparatus body A. As a result, even when the cartridge B is obliquely mounted, the first holding member 52 (body supporting member) having the body electrical contact 54 surely engages with the drum frame 18 of the cartridge B. Therefore, the body electrical contact 54 can be surely connected to the cartridge electrical contact (electrical contact portion 60*a*1 and 60*a*2) in a stable state.

In the present exemplary embodiment, the body electrical contact 54, the engaging portions 52*c* and 52*d* of the first holding member 52, and the engaging portion 53*b*1 and 53*b*2 of the second holding member 53 are provided substantially in parallel with the longitudinal direction of the photosensitive drum 7. The cartridge electrical contact (electrical contact portions 60*a*1 and 60*a*2), the first engaging portion 18*h* and the second engaging portion 18*f* of the drum frame 18, and the third engaging portions 70*d*1 and 70*d*2 of the memory unit attaching base 70 attached to the drum frame 18 are provided substantially in parallel with the longitudinal direction of the photosensitive drum 7. Therefore, the movable contact holding member 50 can be reduced in size.

As described above, according to the exemplary embodiment of the present invention, the body electrical contact provided in the image forming apparatus can be surely brought into contact with the cartridge electrical contact of the memory unit provided in the process cartridge detachably mountable to the image forming apparatus in a stable state.

Before the body electrical contact is electrically connected to the cartridge electrical contact, the body electrical contact can be positioned in the longitudinal direction of the process cartridge and in the direction intersectional to the longitudinal direction.

Also in the long cartridge B, the accuracy of the position in which the body electrical contact is brought into contact with the cartridge electrical contact can be improved.

As described above, in the present exemplary embodiment, the drum frame 18 has the first engaging portion 18*h* and the second engaging portion 18*f*, and the memory unit attaching base 70 is attached to the drum frame 18. The memory unit attaching base 70 may be integrally formed with the drum frame 18.

The drum frame 18 has the first engaging portion 18*h* and the second engaging portion 18*f*, and the memory unit attaching base 70 is attached to the drum frame 18. However, the present invention is not limited thereto. The first engaging portion 18*h*, the second engaging portion 18*f*, and the third engaging portion may be arranged in a process cartridge that does not contain a photoconductive drum.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-243687 filed Nov. 7, 2011, which is hereby incorporated by reference herein in its entirety.

What is claimed is:

1. A process cartridge detachably mountable to an image forming apparatus body including a body supporting member configured to be movable and a body electrical contact supported by the body supporting member, the process cartridge comprising:

a process unit configured to act on an electrophotographic photosensitive member;

a memory member configured to store information about the process cartridge;

a cartridge electrical contact electrically connected to the memory member;

a first engaging portion configured to engage with a first body engaging portion of the body supporting member to temporarily position the body supporting member in a longitudinal direction of the process cartridge before the process cartridge is mounted to a cartridge mounting position provided in the image forming apparatus body and before the body electrical contact is electrically connected to the cartridge electrical contact; and a second engaging portion configured to engage with a second body engaging portion of the body supporting member to position the body supporting member in the longitudinal direction of the process cartridge after mounting of the process cartridge to the cartridge mounting position is further advanced, wherein a clearance between the first engaging portion and the first body engaging portion is greater than a clearance between the second engaging portion and the second body engaging portion in a state where the body supporting member engages with the second engaging portion.

2. The process cartridge according to claim 1, further comprising a third engaging portion configured to engage with the body supporting member to position the body supporting member in a direction intersecting with the longitudinal direction of the process cartridge after mounting of the process cartridge to the cartridge mounting position is further advanced after the body supporting member engages with the second engaging portion.

3. The process cartridge according to claim 1, wherein the first engaging portion and the second engaging portion are located opposite each other in the longitudinal direction across the cartridge electrical contact.

4. The process cartridge according to claim 1, wherein the first engaging portion is arranged closer to a lateral surface of the process cartridge in the longitudinal direction than the second engaging portion.

5. The process cartridge according to claim 2, wherein the first engaging portion and the second engaging portion are located opposite each other in the longitudinal direction across the third engaging portion.

6. The process cartridge according to claim 2, wherein the first engaging portion includes a surface configured to contact the first body engaging portion to guide the body supporting member in the direction intersecting with the longitudinal direction when the process cartridge is mounted to the cartridge mounting position provided in the image forming apparatus body, and wherein the surface is configured such that the surface moves away from the first body engaging portion after the first engaging portion and the second engaging portion engage with the body supporting member, and, when the body supporting member abuts on a regulating portion of the third engaging portion, the cartridge electrical contact is electrically connected to the body electrical contact.

7. The process cartridge according to claim 1, further comprising the electrophotographic photosensitive member.

8. An electrophotographic image forming apparatus including a process cartridge detachably mountable to a body of the image forming apparatus, the body of the image forming apparatus comprising:

a body supporting member configured to be movable;

a body electrical contact supported by the body supporting member; and a mounting portion configured to detachably mount the process cartridge, the process cartridge comprising:

a process unit configured to act on an electrophotographic photosensitive member;

a memory member configured to store information about the process cartridge;

a cartridge electrical contact electrically connected to the memory member;

a first engaging portion configured to engage with a first body engaging portion of the body supporting member to temporarily position the body supporting member in a longitudinal direction of the process cartridge before the process cartridge is mounted to a cartridge mounting position provided in the body of the image forming apparatus and before the body electrical contact is electrically connected to the cartridge electrical contact; and a second engaging portion configured to engage with a second body engaging portion of the body supporting member to position the body supporting member in the longitudinal direction of the process cartridge after mounting of the process cartridge to the cartridge mounting position is further advanced, wherein a clearance between the first engaging portion and the first body engaging portion is greater than a clearance between the second engaging portion and the second body engaging portion in a state where the body supporting member engages with the second engaging portion.

9. The electrophotographic image forming apparatus according to claim 8, wherein the process cartridge further comprises a third engaging portion configured to engage with the body supporting member to position the body supporting member in a direction intersecting with the longitudinal direction of the process cartridge after mounting of the process cartridge to the cartridge mounting position is further advanced after the body supporting member engages with the second engaging portion.

10. The electrophotographic image forming apparatus according to claim 8, wherein the first engaging portion and the second engaging portion are located opposite each other in the longitudinal direction across the cartridge electrical contact.

11. The electrophotographic image forming apparatus according to claim 8, wherein the first engaging portion is arranged closer to a lateral surface of the process cartridge in the longitudinal direction than the second engaging portion.

12. The electrophotographic image forming apparatus according to claim 9, wherein the first engaging portion and the second engaging portion are located opposite each other in the longitudinal direction across the third engaging portion.

13. The electrophotographic image forming apparatus according to claim 9, wherein the first engaging portion includes a surface configured to contact the first body engaging portion to guide the body supporting member in the direction intersecting with the longitudinal direction when the process cartridge is mounted to the cartridge mounting position provided in the body of the image forming apparatus, and wherein the surface is configured such that the surface moves away from the first body engaging portion after the first engaging portion and the second engaging portion engage with the body supporting member, and, when the body supporting member abuts on a regulating portion of the third engaging portion, the cartridge electrical contact is electrically connected to the body electrical contact.

14. The electrophotographic image forming apparatus according to claim 8, wherein the process cartridge further comprises the electrophotographic photosensitive member.

* * * * *